United States Patent [19]

Mauro

[11] 4,404,621

[45] Sep. 13, 1983

[54] METHOD AND DEVICE FOR MOUNTING LIGHTS TO CHRISTMAS TREES

[76] Inventor: Louis D. Mauro, 125 Weldin Park Dr., Wilmington, Del. 19803

[21] Appl. No.: 300,934

[22] Filed: Sep. 10, 1981

[51] Int. Cl.[3] ..... F21M 3/18

[52] U.S. Cl. ..... 362/419; 362/123; 362/430; 362/249; 362/250; 362/252; 362/285; 362/287; 362/806; 362/808; 248/328

[58] Field of Search ..... 362/419, 430, 123, 249, 362/250, 252, 285, 287, 806, 808; 248/328

[56] References Cited

U.S. PATENT DOCUMENTS

| | | | |
|---|---|---|---|
| 2,052,425 | 8/1936 | Simeone | 362/250 |
| 3,096,943 | 7/1963 | Forrer | 362/252 |
| 3,704,366 | 11/1972 | Korb et al. | 362/123 |
| 3,819,459 | 6/1974 | Wren | 362/123 |

*Primary Examiner*—Stephen J. Lechert, Jr.
*Attorney, Agent, or Firm*—Connolly and Hutz

[57] ABSTRACT

Decorative lights are mounted on trees such as Christmas trees or the like by positioning a crown at the top of the tree with the crown including a closed loop collar to which a plurality of elongated tracks are pivotally mounted with a pulley associated with each track and being secured to the collar so that a string of lights may be guided by the track by use of a cord tied to the string and extending over the pulley.

18 Claims, 18 Drawing Figures

Fig. 4.
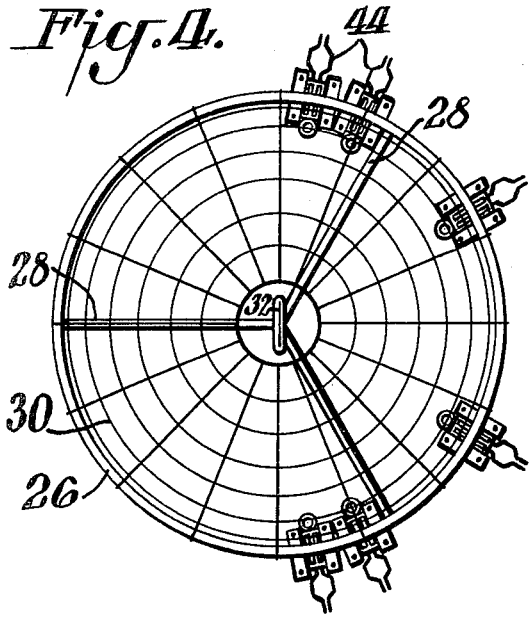
Fig. 6.
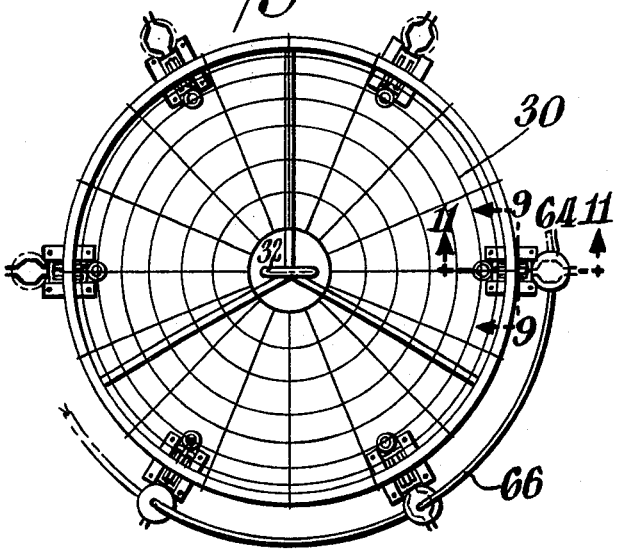
Fig. 3.
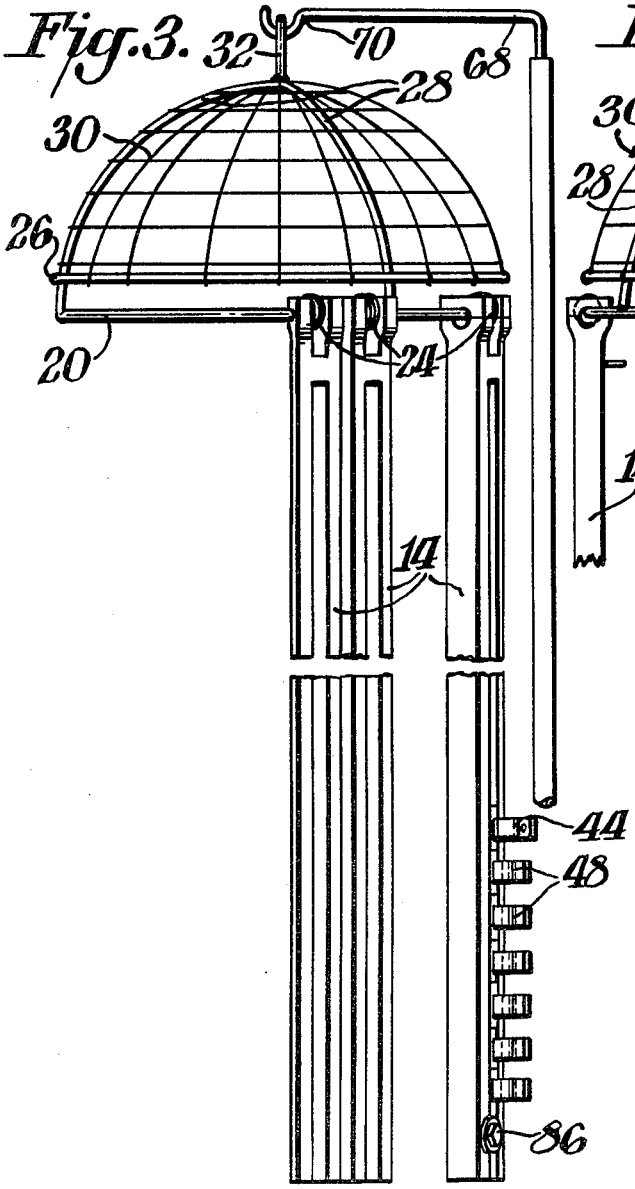
Fig. 5.
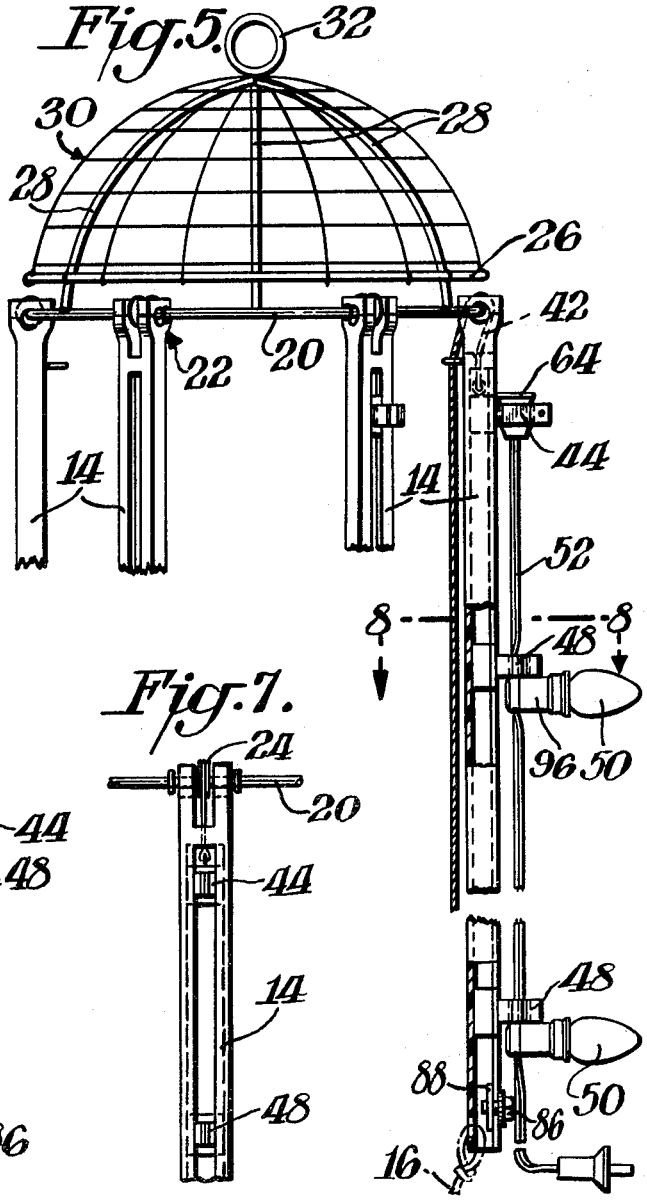
Fig. 7.

METHOD AND DEVICE FOR MOUNTING LIGHTS TO CHRISTMAS TREES

BACKGROUND OF INVENTION

The present invention is directed to providing a method and device for mounting decorative lights or the like to upstanding members and particularly to trees such as Christmas trees. The invention is particularly concerned with outdoor evergreen trees, although it may have application to large indoor trees, poles and other upstanding members.

During the Christmas season many outdoor trees are decorated by stringing lights about the trees. Generally this involves difficult and time consuming effforts to either climb the tree by use of ladders or the like or otherwise somehow mount the lights to the trees. Because of the limitations in the conventional approaches, these approaches are generally confined to either small trees or trees of moderate height with the effectiveness decreasing in accordance with the height of the tree. After the lights have been mounted, it is then necessary to reverse the procedures in order to detach the lights at the end of the season.

There is, therefore, a need for an efficient method and device which can effectively mount decorative lights to evergreen trees or the like in such a manner as to minimize the cost and effort required by the user. There is also a need to provide such a method and device which does not require a repeat of the steps at the beginning and end of each season.

SUMMARY OF INVENTION

An object of this invention is to provide a method and device for fulfilling the above needs.

A further object of this invention is to provide such a method and device whereby the device may be initially mounted on the tree and may include structural elements which may remain indefinitely on the tree and yet permit the decorative lights to be mounted and detached at the desired times.

In accordance with this invention the device includes a crown having a closed loop collar for being positioned on the top of the tree. Pivotally attached to the collar are a plurality of elongated tracks which may be positioned around the tree. Each track has associated therewith a pulley mounted to the collar so that a cord may be placed over the pulley with one end of the cord tied to a string of decorative lights which would be guided by the track while the other end of the cord is manipulated by the user to either raise or lower the lights.

The crown preferably includes netting material secured to spaced struts which in turn is secured to the collar. In the preferred form of this invention the tracks are slidably mounted on the collar so that the tracks may be moved toward each other to provide an open area on the collar and thereby facilitate the positioning of the crown on the tree. Each track is preferably provided with a plurality of guide members with one guide member being provided for each light so that the guide members slide in the track thereby carrying the lights with them.

THE DRAWINGS

FIG. 3 is a side elevation view showing one step in the positioning of the device of FIGS. 1–2 on a tree;

FIG. 4 is a top plan view of the device shown in FIG. 3;

FIG. 5 is a side elevation view partly in section of the device shown in FIGS. 1–4;

FIG. 6 is a top plan view of the device shown in FIG. 5;

FIG. 7 is a side elevation view of the device shown in FIGS. 5–6;

DETAILED DESCRIPTION

Figure 2:
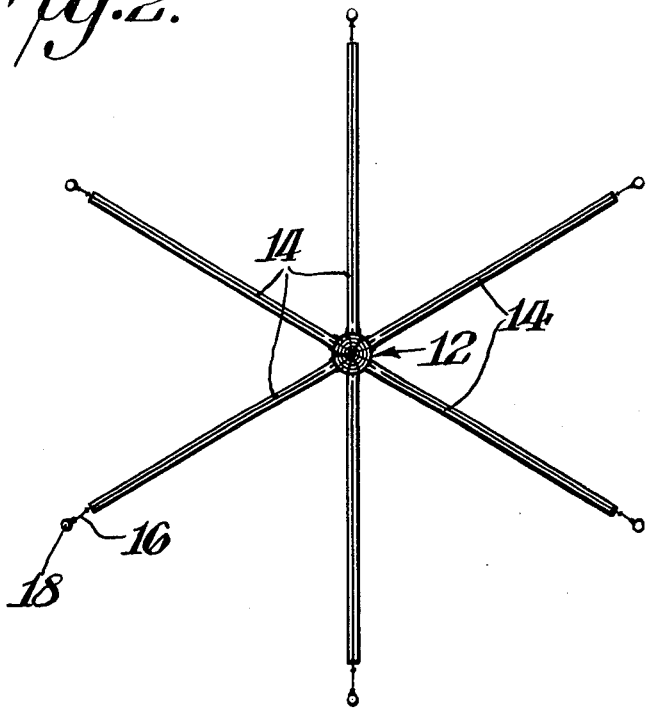
FIG. 2 is a top plan view of the device shown in FIG. 1.
Figure 1:
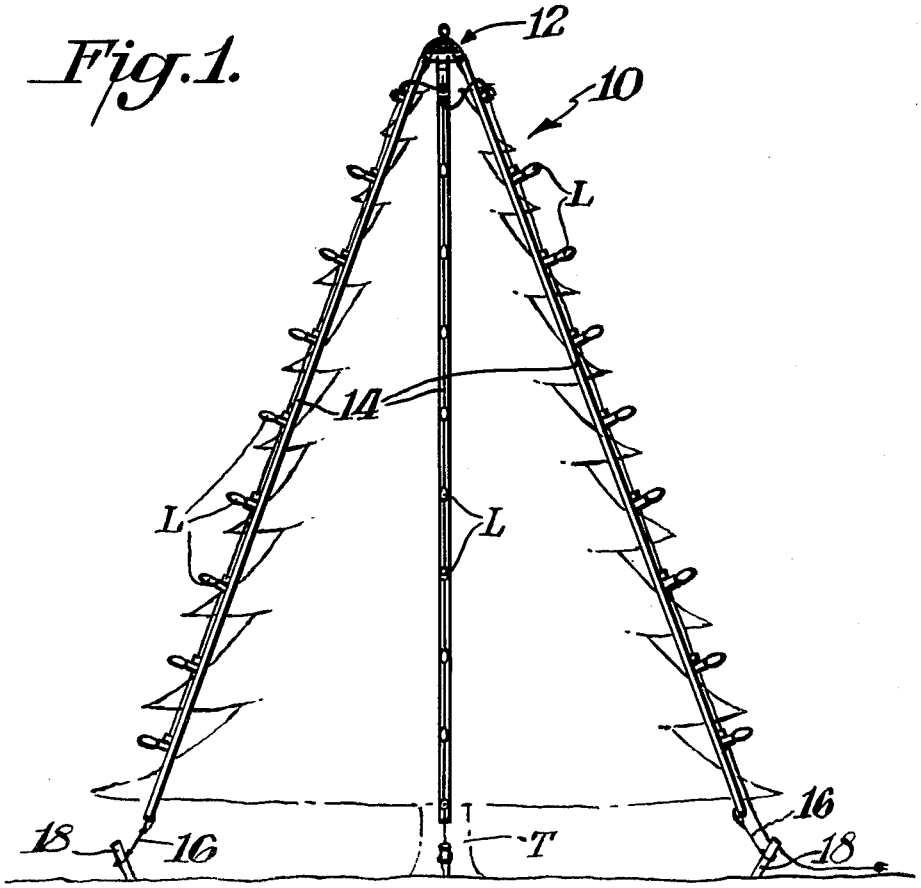
FIG. 1 is a front elevation view of a device for mounting lights on a tree in accordance with one embodiment of this invention.

FIGS. 1–2 show a device 10 for mounting a string of decorative lights or the like to an upstanding element, in particular an evergreen tree T, as is customarily done during the Christmas season. As shown therein, device 10 includes a crown 12 positioned on the top of the tree with a plurality of elongated tracks 14 extending downwardly from crown 12 and anchored to the ground in any suitable manner. FIG. 1, for example, indicates the anchoring to be achieved by a tether 16 secured at one end to a respective track 14 and at the other end to a stake 18. As later discussed, tracks 14 in combination with crown 12 permit the positioning of a string of decorative lights L on the tree T.

The details of device 10 are better shown in FIGS. 5–6. As indicated therein, crown 12 includes a collar 20 in the form of a closed loop preferably forming a circle with the tracks 14 being pivotally mounted thereon as later described. Each track 14 terminates at its upper end in a fork or bifurcation 22 which is apertured so as to fit around collar 20. Also mounted on collar 20 within the spaced legs of the bifurcation 22 is a pulley 24. Pulley 24 and track 14 function as a unit in the manner later described.

Collar 20 of crown 12 functions to allow the positioning of the tracks 14 about the tree T. Crown 12 also includes, however, elements whereby the device may be mounted on the tree. These elements include an upper rim 26 spaced above and parallel to annual collar 20. A plurality of spaced struts 28 connect collar 20 and rim 26 and are connected to each other at the upper end to provide a framework on which a netting material 30 such as wire or nylon mesh may be secured. A positioning member 32 which may be a loop or hook or the like is also secured to struts 28 at the upper end of crown 12.

Figure 8:
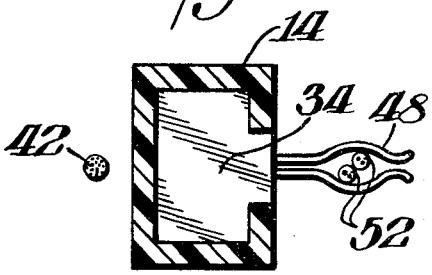
FIG. 8 is a cross-sectional view taken through FIG. 5 along the line 8—8.

As best shown in FIG. 8, track 14 is generally of a C-type cross-sectional configuration or open loop form so as to provide a confined path in which guiding elements 34 may be slidably mounted including upper guiding element 36 which differs from the remaining guiding elements.

In the preferred form of this invention, each guiding element is a block generally conforming to the inside shape of track 14, and each guiding element includes retaining means for securement to the string of lights so that the guiding elements and string of lights move conjointly with respect to track 14.

Upper guiding block 36 has secured thereto a fastening element 38 which terminates in a loop 40 or any other suitable structure so that a cord 42 or other suitable manipulating member such as a wire, rope or the like may be fastened to guiding block 36. Guiding block 36 also includes a pair of spring fingers 44 as its retaining means for holding the electrical connector of the respective string of lights. Aligned apertures 46 may be provided in the outer portions of spring fingers 44 so that any locking element such as a pin, bolt/nut or other fastener and may be secured to prevent fingers 44 from spreading apart and thereby assuring that the electrical connector is firmly held to block 36. If desired, similar locking elements may be secured to spring fingers 48 of the lower guide blocks, but such is not as necessary since the lower guide blocks function primarily to hold the electrical wires and not the heavier electrical connector.

Each lower guiding block 34 would be positioned above an individual light 50 and would hold the electrical wires 52 of that light. As upper guide block 36 is raised by a pulling on cord 42, the upward movement would cause electrical wires 52 to become taut which in turn would result in light 50 exerting an upward push on its respective guiding block 34.

In order to facilitate the manipulation of cord 42, track 14 includes at its upper end an elongated aperture 54 providing a passageway for cord 42 toward pulley 24 so that cord 42 may then pass over pulley 24 and then downwardly through loop or guiding element 56 which likewise is secured to the upper end of track 14. After lights 50 have been raised to their desired location by the downward pull on the free end of cord 42, the free end may be anchored in any suitable manner such as by tying it to a tree branch or to a portion of the track itself.

Figure 10:
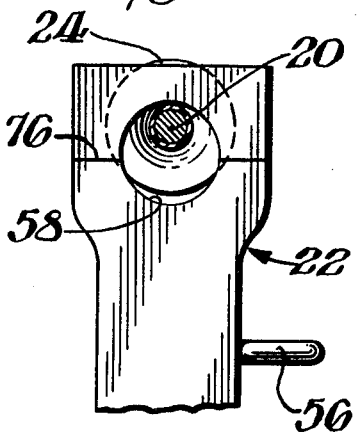
FIG. 10 is a side view of a portion of the device shown in FIG. 9.
Figure 9:
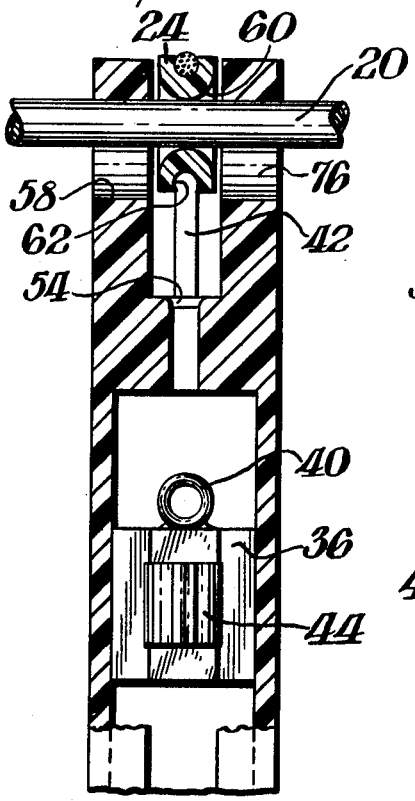
FIG. 9 is a cross-sectional view taken through FIG. 6 along the line 9—9.

Device 10 is particularly designed to take into account the problems that might be encountered in mounting device 10 on a tree. Thus tracks 14 are pivotally mounted about collar 20 so that the tracks may pivot toward or away from the tree trunk in accordance with the particular tree structure. Additionally tracks 14 are slidably mounted on collar 20 for purposes later described. The slidable mounting is facilitated by forming the apertures 58 in the bifurcated legs of track 14 somewhat oversized with respect to the cross-sectional diameter of collar 20. (See FIGS. 9–11.) Additionally pulley 24 includes arcuate bearing surfaces 60 to minimize binding. A further feature of pulleys 24 is in forming the inner cord engaging surfaces 62 of arcuate form greater than 180° so that the cord could be snapped into pulley 24 with enough clearance for longitudinal movement without tending to be disengaged from pulley 24.

FIGS. 3–4 show the condition of device 10 during its phase of installation. As indicated therein, electrical connectors 64 would be secured in the respective spring fingers 44 of each track 14. The tracks in turn would be slid so as to be generally bunched together over an arc less than 180° thereby providing an open area to minimize interference of the tracks with the tree branches during mounting of device 10. The connecting wires 66 (FIG. 6) would also be secured between the adjacent pairs of electrical connectors 64 and the electrical wires 52 would be secured in their respective spring fingers 48. As shown in FIG. 3, the various mounting blocks 36 and 34 would be at the lower end of each track 14. Cord 42 would be secured to fastener 40, threaded through aperture 54, snapped into pulley 24 and threaded through loop 56, and free ends of each cord 42 may be temporarily tied to respective track or the cords may hang loosely or otherwise be secured in any convenient manner. A mounting element such as elongated pole 68 having a hook 70 at one end thereto would be utilized for mounting device 10. As shown in FIGS. 3–4, hook 70 would be inserted through loop 32, and device 10 would thereby be raised and manipulated above tree T and then lowered so that crown 12 would rest on the top of tree T. Tool 68 would then be disengaged from loop 32. Tracks 14 would be pivoted outwardly away from the branches of the tree and the same tool 68 could be used to facilitate sliding each track around collar 20 to the desired position so that by repeating this process for each track, a symmetrical or any desired arrangement for the tracks could be had around tree T. The pivotal movement of the tracks also permits each track to be worked into the spaces afforded by the branches of the tree.

Although all of the tracks are shown to be slidable on collar 20, if desired, certain of the tracks could be fixedly mounted on collar 20 as long as enough slidable tracks are provided to provide an open area on collar 20 to facilitate the placement of device 10 on the tree.

Tracks 14 as well as all of the remaining components of device 10 are preferably made of a light weight material. For example, tracks 14 would be made of a suitable plastic which could be transparent or colored green or otherwise to best blend in with the tree coloring. Collar 20 is preferably made of an aluminum rod having a plastic cover, and rim 26 is likewise a plastic material. Tracks 14 would also preferably be thin enough and of a material which would permit some flexing to further facilitate the manipulation of the tracks as it is being worked into and between the branches.

Figure 12:
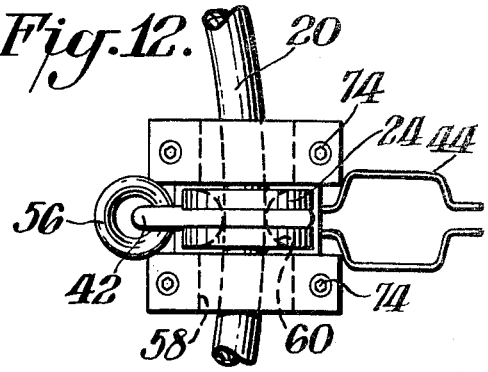
FIG. 12 is a top plan view of the device shown in FIG. 11.
Figure 11:
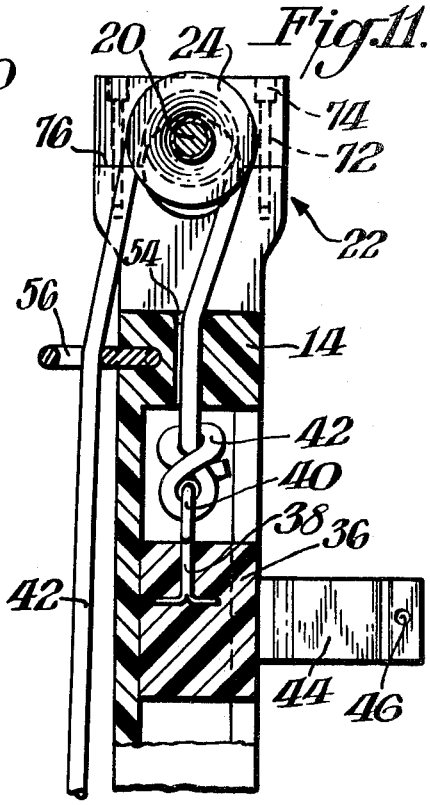
FIG. 11 is a cross-sectional view taken through FIG. 6 along the line 11—11.

Device 10 is also formed so as to accommodate trees of different heights and to permit the replacement of parts. FIGS. 11–12, for example, show upper portion 22 of track 14 to be formed in detachable sections in the area of a pulley 24 should it be necessary to replace a track section. This is accomplished in any suitable manner such as by providing tapped passageways 72 so that fasteners 74 may extend completely through the upper portion of end 22 past the break line or junction 76.

Figure 15:
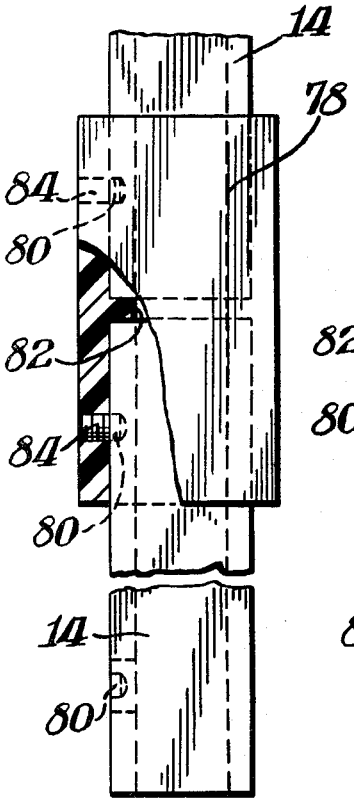
FIG. 15 is a side elevation view partly broken away and in section showing the securement together of two track sections usable in the invention illustrated in FIGS. 1–14.
Figure 16:
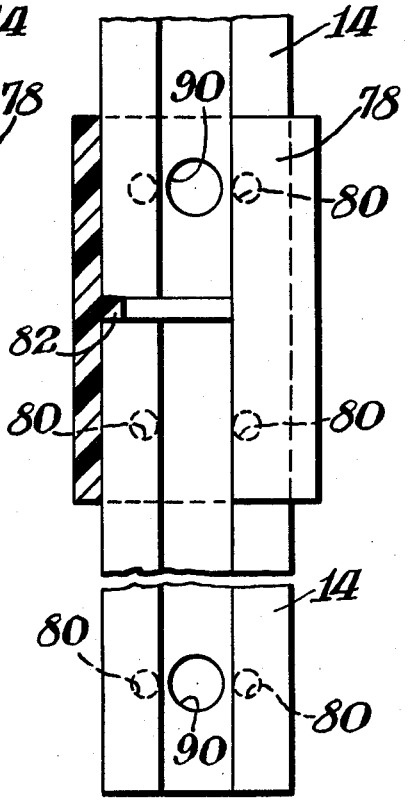
FIG. 16 is a front elevation view partly in section of the device shown in FIG. 15.

FIGS. 15–16 show yet another feature of this invention which permits track 14 to be made in sections which are joined together. As indicated therein, a connecting member 78 of H-shape in cross section is provided for telescopically receiving ends of adjacent track sections 14. Each track section 14 would have indents 80 positioned so that when the track section abuts intermediate wall 82 of connector 78, any suitable fastener such as set screws 84 may be inserted through predrilled holes in connector 78 and engage dimples or indents 80.

Figure 14:
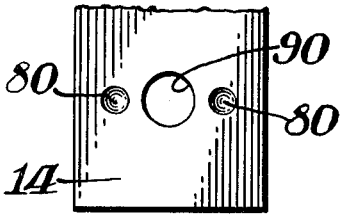
FIG. 14 is a side elevation view of the portion of the device shown in FIG. 13.
Figure 14:
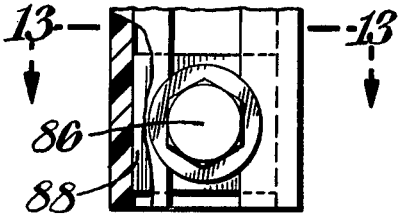
Figure 13:
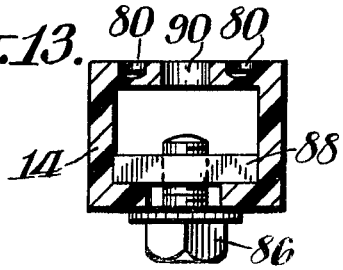
FIG. 13 is a cross-sectional view taken through FIG. 9 along the line 13—13.

FIGS. 13–14 show another aspect of this invention wherein provisions are made to prevent blocks 34 from being easily removed from track 14. As indicated therein, the open portion of track 14 is closed at its lower end in any suitable manner such as by fastening a bolt 86 to a nut or locking member 88 so that blocks 34 cannot slide out of the bottom of track 14. Alternately the bolt may completely traverse track 14 and extend through aperture 90 with a bolt then being secured externally of track 14. Aperture 90 could also be used for anchoring one end of tether 16.

Figure 18:
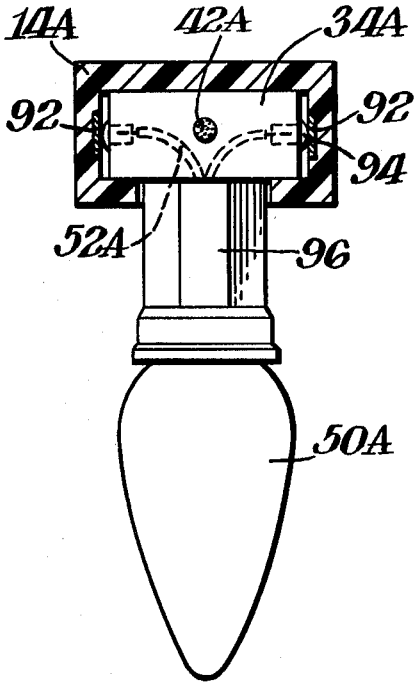
FIG. 18 is a cross-sectional view taken althrough FIG. 17 along the line 18—18.
Figure 17:
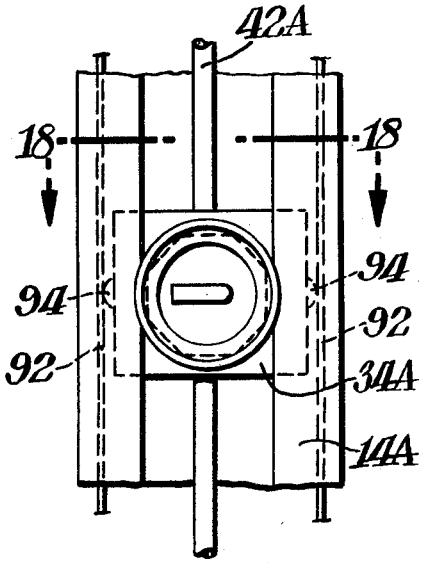
FIG. 17 is a side elevation view of a modified form of this invention.

FIGS. 17–18 show yet another variation of this invention wherein instead of using a conventional string of lights, the electrical contacts are made by device 10 itself. In this respect track 14A includes as electrical contact strips 92, 92 on opposite sides of track 14A. Blocks 34A would be specifically designed to complete the electrical connection by having contact points 94, 94 located for riding against contact strips 92 with contact points 94 being in electrical contact with wires 52A of each light 50A. Advantageously sockets 96 are specifically shaped such as hexagonally or rectangularly shaped so as to fit within the open ends of track 14A and prevent the light from twisting since light 50A is fixedly mounted to block 34A and such twisting movement might result in breaking the electrical contact between contact strips 92 and contact points 94.

Although this invention has been particularly described with respect to mounting decorative lights on outdoor Christmas trees, the invention in its broadest aspect is not limited to such specific application. Thus, for example, the concepts of this invention may be practiced wherever it is desirable to mount hanging elements from the top of an elongated vertical structure. For example, strings of lights may be mounted to the top of poles, street lights or the like and extended outwardly therefrom to simulate the general shape of a Christmas tree or lights or other decorations may be mounted from any vertical object for any desired purpose not necessarily associated with the Christmas season.

What is claimed is:

1. A device for mounting lights to an upstanding tree or the like comprising a crown for being positioned at the top of the tree, said crown including a closed loop collar, a plurality of elongated tracks pivotally mounted to and extending from said collar, each of said tracks having a pulley associated therewith mounted on said collar, guide means slidably mounted in each of said tracks, and said guide means including retaining means whereby a string of lights or the like may be secured to said guide means and selectively moved toward and away from said crown by a cord or the like secured to said string and positioned over a respective one of said pulleys.

2. The device of claim 1 wherein said crown comprises a framework secured to said collar and fastening means secured to said framework remote from said collar.

3. The device of claim 1 wherein at least some of said tracks are slidably mounted on said collar whereby said tracks may be disposed over an arc no greater than 180° around said collar to facilitate the mounting of said device on a tree or the like.

4. The device of claim 3 wherein each of said tracks terminates in a bifurcated end confining said pulley between the bifurcations thereof, and guide means for guiding a cord around said pulleyy with respect to said track.

5. The device of claim 4 wherein said guide means comprises a passageway extending through the upper end of said track and a guide member mounted to and extending externally of said track whereby a cord may pass through said passageway and over said pulley and through said guide member.

6. The device of claim 1 wherein each of said tracks is made of said detachable sections.

7. The device of claim 6 wherein said track sections are detachable from each other and from said collar.

8. The device of claim 1 wherein said track has an internal open loop guide surface, and said guide means including a plurality of blocks conforming to said guide surface and slidable in said track.

9. The device of claim 8 wherein the upper one of said blocks in said track includes means for securement of the cord thereto and includes spring fingers as its said retaining means for detachable attachment of the electrical connector for said string, each remaining block in said track including spring fingers as its said retaining means for detachably mounting the electrical wires of said string thereto.

10. The device of claim 9 including locking means for mounting at least one set of said spring fingers together.

11. The device of claim 9 including means for closing the bottom of said track to prevent said blocks from being removed therefrom.

12. The device of claim 1 wherein said tracks include an inner guide surface for said guide means, electrical contact strips being secured to said inner guide surface, said guide means including electrical contact points for making sliding electrical contact with said contact strips and each of said lights being electrically connected to said contact points.

13. A method of mounting lights or the like to an upstanding member such as a tree comprising providing a plurality of elongated tracks pivotally connected to a closed loop collar, inserting a plurality of guide blocks in each of the tracks, detachably securing a string of lights to retaining members on the blocks, positioning the collar on the top of the upstanding member, positioning the tracks around the member and raising the guide blocks by means of a cord secured to the uppermost guide blocks with the cord extending over a pulley associated with each track.

14. The method of claim 13 including slidably mounting at least some of the tracks on the collar, and sliding the tracks toward each other to confine the tracks on the collar over an arc less than 180°.

15. The method of claim 14 including detachably securing the device to a manipulating tool, raising the device above the upstanding member by means of the manipulating tool, lowering the device onto the upstanding member, detaching the manipulating tool, and sliding the tracks on the collar to position the tracks around the tree.

16. The method of claim 13 including interconnecting the guide blocks with each other by means of the guide blocks being secured to the electrical wires of the string of lights with the uppermost guide block being secured to the electrical connector of the string of lights, and pulling downwardly on the end of the cord remote from the track to progressively raise the guide blocks and string of lights.

17. The method of claim 16 including securing each guide block other than the uppermost guide block to the electrical wire below a respective light and raising the lights by pushing each respective light upwardly against its guide block.

18. The method of claim 13 including providing electrical contact strips in each track and providing each light secured to its respective guide block in electrical contact with contact points on its respective guide block, and making electrical contact between the lights and the contact strips by means of the contact points.

* * * * *